US007370590B2

(12) United States Patent
Tajima et al.

(10) Patent No.: US 7,370,590 B2
(45) Date of Patent: May 13, 2008

(54) SEQUIN FEEDER APPARATUS

(75) Inventors: Ikuo Tajima, Nagoya (JP); Satoru Suzuki, Komaki (JP); Kenji Suzuki, Niwa-gun (JP)

(73) Assignee: Tokai Kogyo Mishin Kabushiki Kaisha (JP)

( * ) Notice: Subject to any disclaimer, the term of this patent is extended or adjusted under 35 U.S.C. 154(b) by 0 days.

(21) Appl. No.: 11/569,474

(22) PCT Filed: May 26, 2005

(86) PCT No.: PCT/JP2005/009631

§ 371 (c)(1),
(2), (4) Date: Nov. 21, 2006

(87) PCT Pub. No.: WO2005/116318

PCT Pub. Date: Dec. 8, 2005

(65) Prior Publication Data

US 2007/0193488 A1 Aug. 23, 2007

(30) Foreign Application Priority Data

May 27, 2004 (JP) ..... 2004-157588

(51) Int. Cl.
*D05B 3/12* (2006.01)
*D05B 3/00* (2006.01)

(52) U.S. Cl. ..... 112/99; 112/113

(58) Field of Classification Search ..... 112/104, 112/98, 99, 113, 101
See application file for complete search history.

(56) References Cited

U.S. PATENT DOCUMENTS

| | | | | |
|---|---|---|---|---|
| 3,390,650 | A * | 7/1968 | Ochsner | 112/88 |
| 4,848,253 | A * | 7/1989 | Tajima | 112/99 |
| 5,562,057 | A * | 10/1996 | Lenson | 112/88 |
| 5,755,168 | A | 5/1998 | Gunther et al. | |
| 7,082,884 | B2 * | 8/2006 | Tajima et al. | 112/99 |

FOREIGN PATENT DOCUMENTS

| | | | |
|---|---|---|---|
| DE | 9209764 | U1 | 9/1992 |
| JP | 62-179492 | A | 8/1987 |

OTHER PUBLICATIONS

Relevant portion of International Search Report for corresponding Int. Appl. No.PCT/JP2005/009631.

* cited by examiner

*Primary Examiner*—Ismael Izaguirre
(74) *Attorney, Agent, or Firm*—Rossi, Kimms & McDowell, LLP

(57) ABSTRACT

Continuous sequin strip having a multiplicity of continuously-connected sequins is let out from a reel and then placed on the upper surface of a supporting plate. Sequin feeder apparatus feeds the sequin strip at a predetermined pitch corresponding to a size of a sequin of the continuous sequin strip through advancing and retracting movement of a feed lever interlocked to sewing operation of a needle bar of a sewing machine. The feed lever includes two engaging portions for engaging a predetermined sequin of the strip to feed the strip. With the two engaging portions engaging at least two points of the sequin, the sequin can be fed out reliably irrespective of the position of the sewing hole formed in the sequin. Thus, even sequins, each having the sewing hole eccentrically offset in a direction perpendicular to a sequin-strip feeding direction, can be fed out at the predetermined pitch with an increased reliability.

7 Claims, 14 Drawing Sheets

SEQUIN FEEDER APPARATUS

This application is a U. S. National Phase Application of PCT International Application PCT/JP2005/009631 filed on May 26, 2005.

TECHNICAL FIELD

The present invention relates to sequin feeder apparatus for use in sewing machines which sew a sequin onto a sewing workpiece while severing the sequin from a ribbon or strip of continuously-connected sequins. More particularly, the present invention relates to an improved sequin feeder apparatus which can also appropriately deal with a sequin having a sewing hole eccentrically displaced or offset from the center of the sequin in a direction perpendicular to a predetermined sequin feeding direction.

BACKGROUND ART

Example of the conventional sequin feeder apparatus is known from German Utility Model Registration No. G9209764.2 (patent literature 1), U.S. Pat. No. 5,755,168 (patent literature 2) or German Patent No. DE19538084 (patent literature 3) (corresponding to U.S. Pat. No. 5,755,168 above). Such a conventional sequin feeder apparatus includes a feed mechanism, which causes a strip of a multiplicity of continuously-connected sequins (spangles) to be played out or let out from a reel, having the continuous sequin strip wound thereon, onto the upper surface of a supporting plate and then, through predetermined forward and rearward (i.e., advancing and retracting) movement of a feed lever, feeds the continuous sequin strip at a predetermined pitch corresponding to the size of each sequin of the strip. One sequin is sewn at a time onto a sewing workpiece while being severed from the continuous sequin strip having been fed in interlocked relation to sewing operation by a needle bar of the sewing machine.

As well known in the art, each sequin has a sewing hole such that the sequin is sewn onto a sewing workpiece by the sewing needle being passed through the sewing hole. The feed lever feeds the sequin strip by causing its distal end to engage the sewing hole of a predetermined sequin and advancing the distal end engaging the sewing hole, and then it retracts the distal end to engage the sewing hole of a predetermined succeeding sequin of the sequin strip.

There are a variety of sequins having various different contours and various different sizes. FIG. 14(*a*) shows examples of strips of continuously-connected circular-shaped, rectangular-shaped and flower-shaped sequins. Although the sequins of the types shown in the figure differ in shape and size, they all have the sewing hole in the sequin center. Further, with each of the sequin feeder apparatus disclosed in patent literature 1 to patent literature 3 mentioned above, it is possible to reliably feed out sequins at a predetermined pitch because the apparatus feeds out each predetermined sequin by causing the distal end of the feed lever to engage the sewing hole (in other words, because the sewing holes of the individual sequins is located on an imaginary line connecting between the connecting portions of the individual sequins) so that a feeding force applied by the distal end of the feed lever acts on the imaginary line connecting between the connecting portions of the individual sequins.

In recent years, various modified sequins of types as illustrated in FIGS. 14(*b*) and 14(*c*) have also appeared, which have the sewing hole offset from the sequin center, in order to enhance the decorativeness of a product with these sequins sewn thereto. For a continuous sequin strip having sequins of the type having the sewing hole offset from the sequin center in the sequin feeding direction (arrow A in FIG. 14(*b*)) as illustrated in FIG. 14(*b*), the conventional arrangements, where each sequin is fed out by the distal end of the feed lever engaging the sewing hole, can reliably feed the continuous sequin strip a predetermined pitch at a time with no problem because the sewing holes of the individual sequins are located on the imaginary line connecting between the respective connecting portions of the sequins. However, for a continuous sequin strip having sequins of the type having the sewing hole offset in a direction perpendicular to the sequin feeding direction as illustrated in FIG. 14(*c*), the sequin feed-out operation by the conventional arrangements would become far less reliable. Namely, for the continuous sequin strip having sequins of the type shown in FIG. 14(*c*), the conventional technique, arranged to feed out a predetermined sequin through one-point engagement by the distal end of the feed lever, undesirably produces a force to rotate the sequin generally about the connecting portion, so that the connecting portion would be deformed and the sequin would be inclined about the vertical axis. If the sequin has been inclined about the vertical axis in this way, the feeding at the predetermined pitch can not be performed appropriately, and thus, the sequin to be fed out can not be appropriately severed from the sequin strip in the connecting portion.

DISCLOSURE OF THE INVENTION

In view of the foregoing, it is an object of the present invention to provide a sequin feeder apparatus which can reliably feed sequins at a predetermined pitch even where the sequins have their sewing hole offset in a direction perpendicular to a sequin In order to accomplish the above-mentioned object, the present invention provides an improved sequin feeder apparatus, which comprises: a feed mechanism for feeding a continuous sequin strip having a multiplicity of continuously-connected sequins, let out from a holder member having the continuous sequin strip held thereon and then placed on an upper surface of a supporting plate, at a predetermined pitch corresponding to a size of a sequin of the continuous sequin strip in interlocked relation to sewing operation of a sewing machine; and a mechanism for severing a sequin from the continuous sequin strip, having been fed by the feed mechanism in interlocked relation to sewing operation of a needle bar of the sewing machine, so that the severed sequin can be sewn onto a sewing work piece, and characterized in that the feed mechanism includes at least two engaging portions engageable with a predetermined sequin of the continuous sequin strip to feed the continuous sequin strip, the continuous sequin strip being fed by the engaging portions engaging at least two points of the continuous sequin strip. By the provision of the two engaging portions, the continuous sequin strip can be engaged at least two points thereof so that it can be fed with an increased reliability.

Preferably, at least one of the engaging portions provided in the feed mechanism is adjustable in position relative to the other engaging portion. Preferably, the feed mechanism further comprises a lock lever for immovably locking the continuous sequin strip during retracting movement of the engaging portions; namely, the lock lever may have at least two engaging claws for engaging a predetermined sequin of the continuous sequin strip, and the continuous sequin strip may be immovably locked by the engaging claws engaging at least two points of the continuous sequin strip. With such engaging claws, the continuous sequin strip can be engaged and immovably locked at least two points thereof. Preferably, at least one of the engaging claws of the lock lever of the feed mechanism is adjustable in position relative to the other engaging claw.

Namely, according to the present invention, the feed mechanism includes at least two engaging portions engageable with a predetermined sequin of the continuous sequin strip to feed the continuous sequin strip, and the continuous sequin strip is fed by the engaging portions engaging at least two points of the continuous sequin strip. For example, the continuous sequin strip may be fed with the two engaging portions engaging (abutting against) two different peripheral points of the predetermined sequin. Thus, irrespective of the position of the sewing hole, each sequin can be reliably fed out at a predetermined pitch with no force acting on the sequin to rotate the sequin generally about the connecting portion and hence with no unwanted inclination (about the vertical axis) of the sequin due to deformation of the connecting portion. Further, with the arrangement that at least one of the engaging portions of the feed mechanism is adjustable in position relative to the other engaging portion, the other engaging portion can be caused to abut against a peripheral region of a predetermined sequin even when the one engaging portion is caused to engage the sewing hole of the sequin. Thus, the position where the engaging portions and sequin engage with each other differs among sequins, each of the engaging portions can reliably engage a predetermined sequin, so that sequins can be fed out at a predetermined pitch. Further, because the feed mechanism includes at least two engaging claws for engaging a predetermined sequin of the continuous sequin strip to thereby immovably lock the continuous sequin strip, it is possible to reliably prevent unnecessary movement of the continuous sequin strip during the retracting movement of the above-mentioned engaging portions.

BEST MODE FOR CARRYING OUT THE INVENTION

Figure 1:
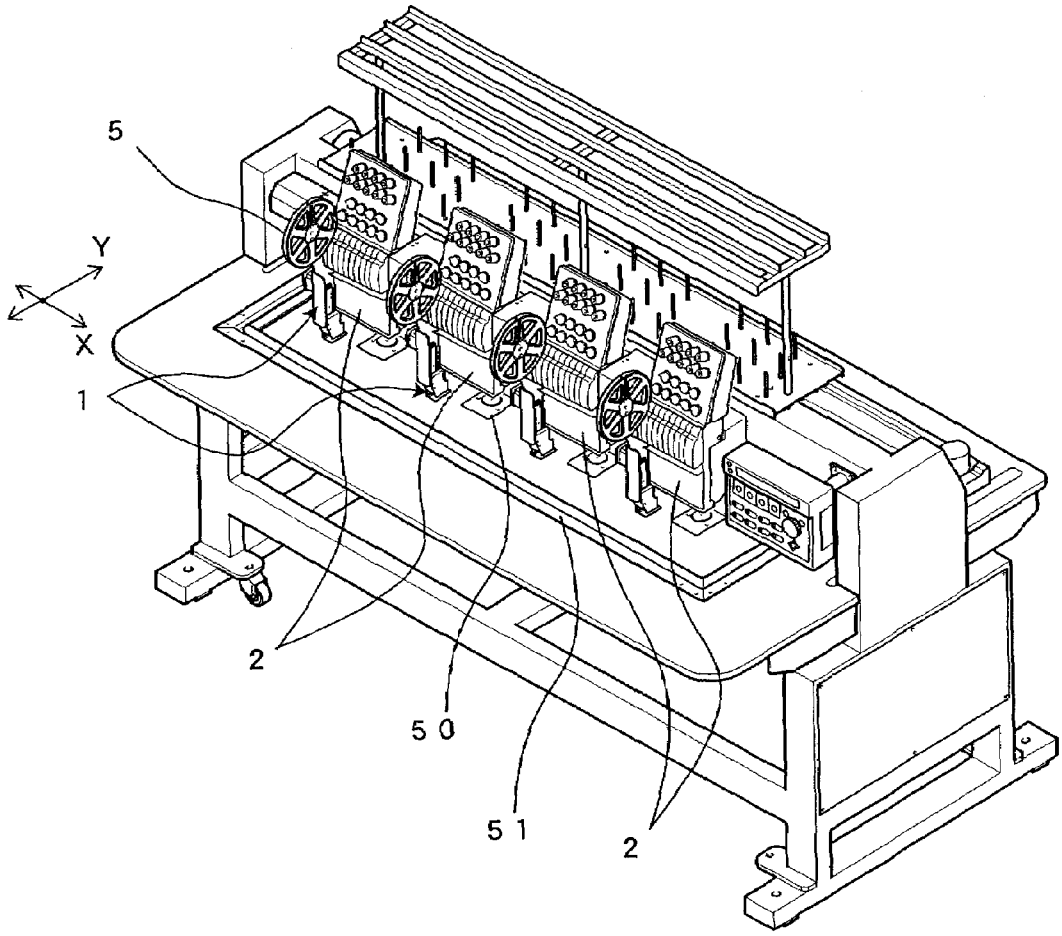
FIG. 1 is a perspective view showing a general outer appearance of an embroidery sewing machine to which is applied a sequin feeder apparatus in accordance with an embodiment of the present invention.

FIG. 1 shows a four-head embroidery sewing machine equipped with four sewing machine heads and constructed in accordance with an embodiment of the present invention. Needle bar cases 2 are provided in corresponding relation to the sewing machine heads, and a needle plate 50 is disposed under the needle bars of each of the machine heads.

Sequin sewing unit 1 is attachable to the left side and/or right side of each of the needle bar cases 2; in the instant embodiment, the sequin sewing unit 1 is attached to only the left side of the associated needle bar case 2. Each of the needle bar cases 2 comprises a multi-needle structure, and, in the case where the sequin sewing unit 1 is attached to the left side of the associated needle bar case 2 as in the illustrated example, the leftmost needle in the needle bar case 2 is used as a sequin sewing needle. As conventionally known in the art, an embroidery frame 51 is driven in horizontal left-right (X) and front-rear (Y) directions in accordance with predetermined sewing data. Each of the sequin sewing units 1 includes a reel 6 having a continuous sequin strip wound thereon.

Figure 2:
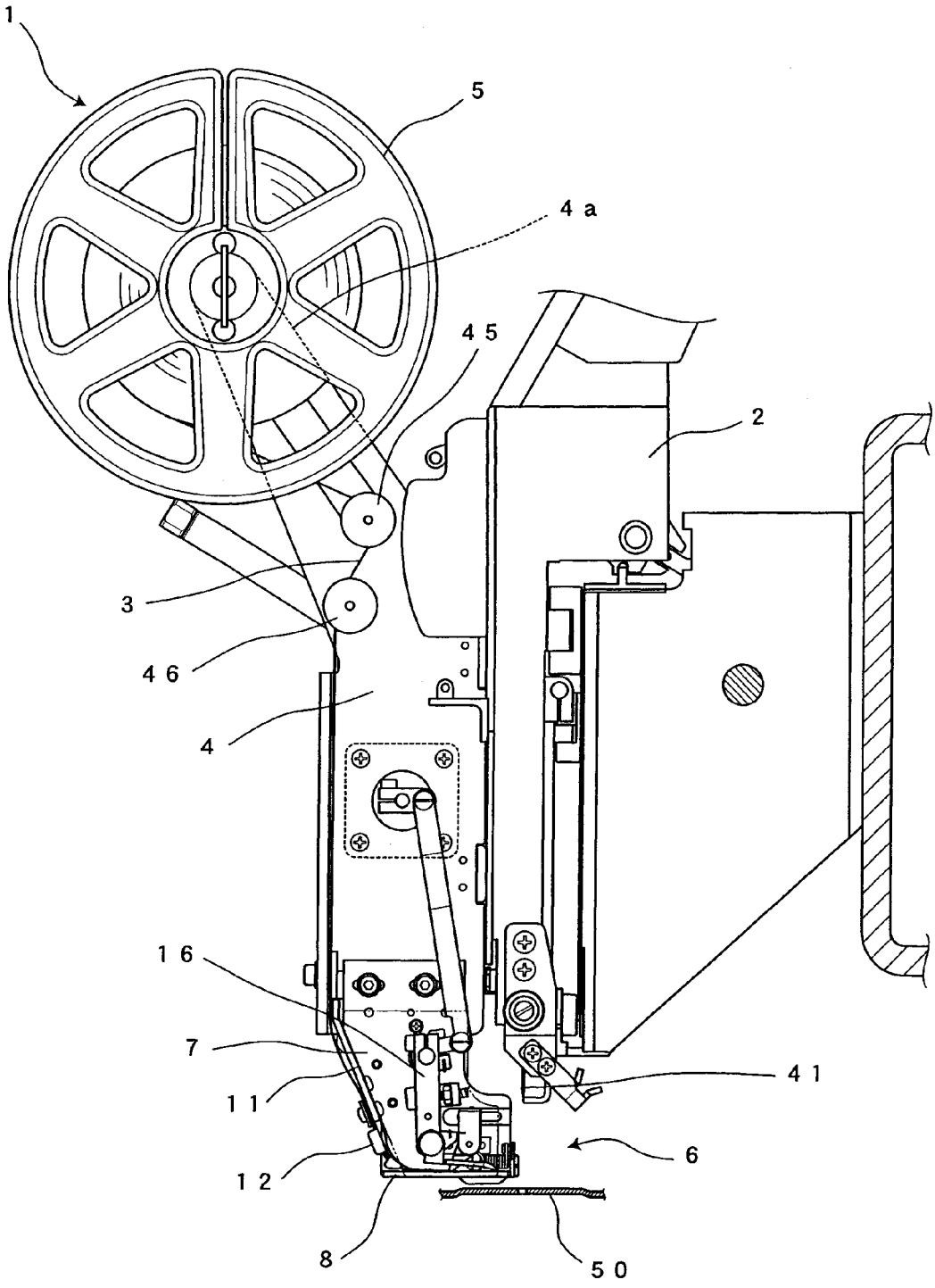
FIG. 2 is a side view showing in enlarged scale a part of a sequin sewing unit employed in the embodiment of the present invention.
Figure 3:
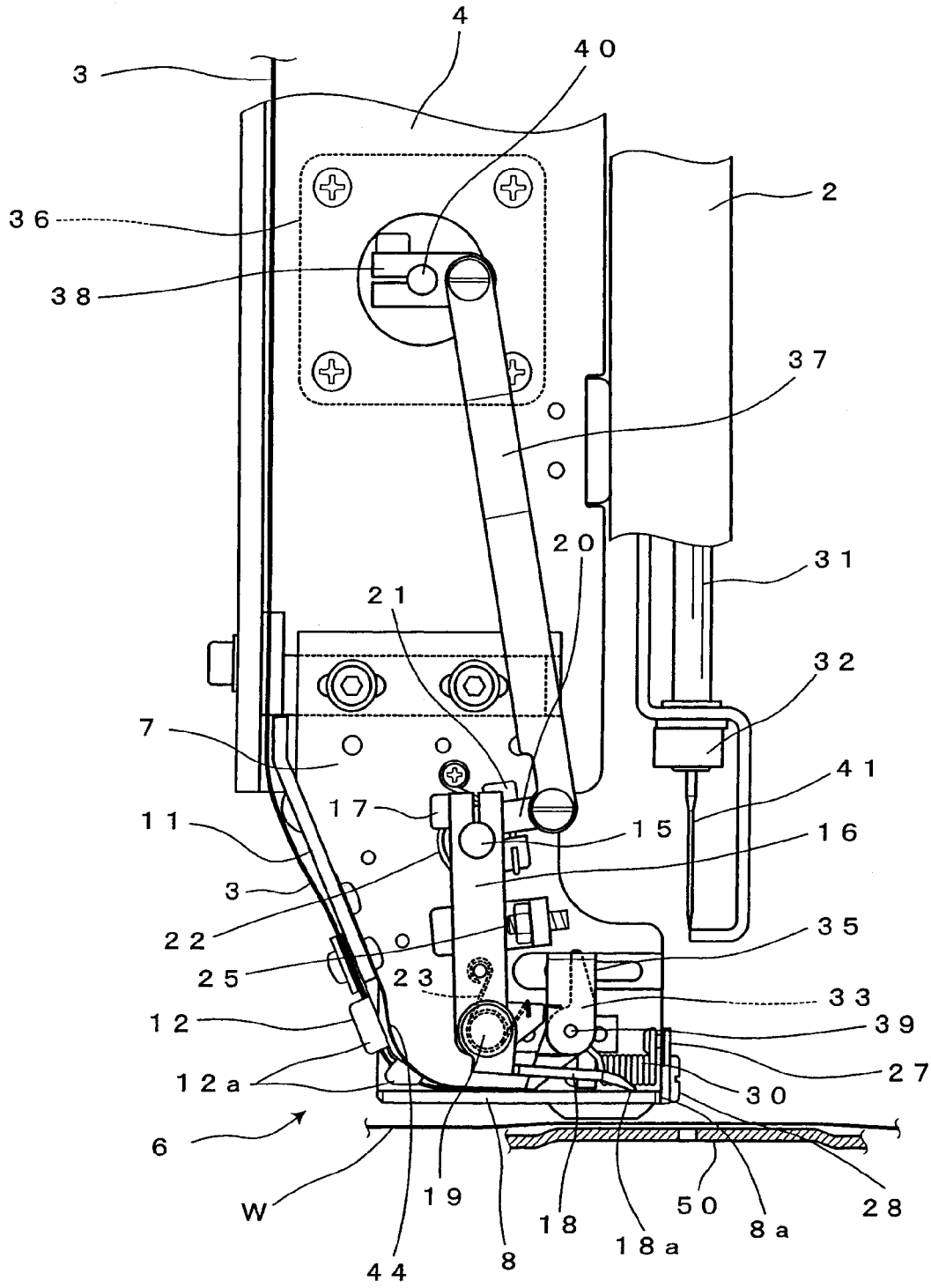
FIG. 3 is a side view showing in enlarged scale a sequin feeder apparatus in the sequin sewing unit in the embodiment of the present invention.
Figure 4:
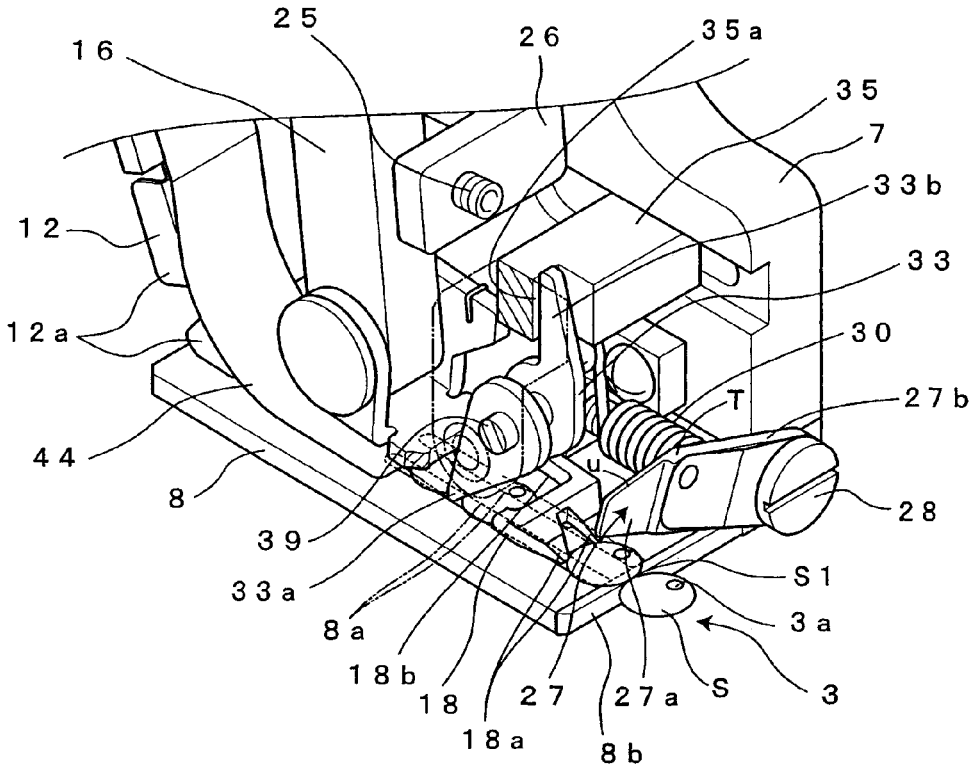
FIG. 4 is a partly-broken-away perspective view showing in enlarged scale relevant sections of the sequin feeder apparatus shown in FIG. 3.
Figure 5A:
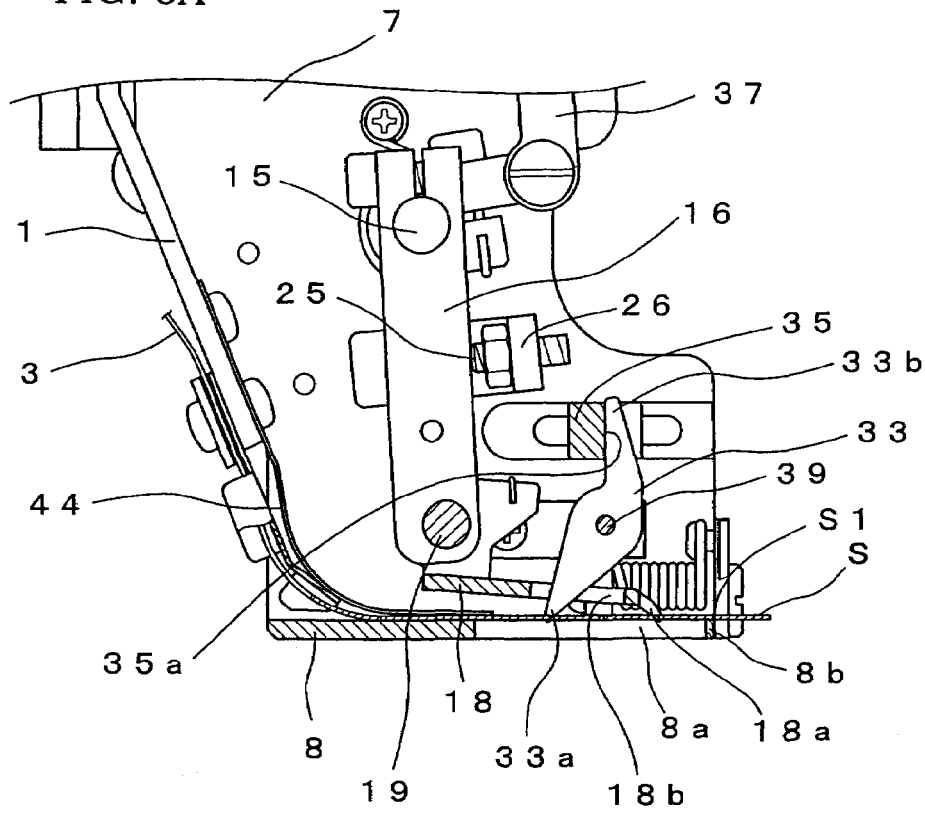
FIG. 5(*a*) is a partly-sectional side view showing the relevant sections of the sequin feeder apparatus of FIG. 4 and particularly showing a state at a time point when one sequin feeding operation cycle has been completed with a feed lever advanced to the forwardmost position, and FIG. 5(*b*) is a schematic plan view of the sequin feeder apparatus in that state.
Figure 5B:
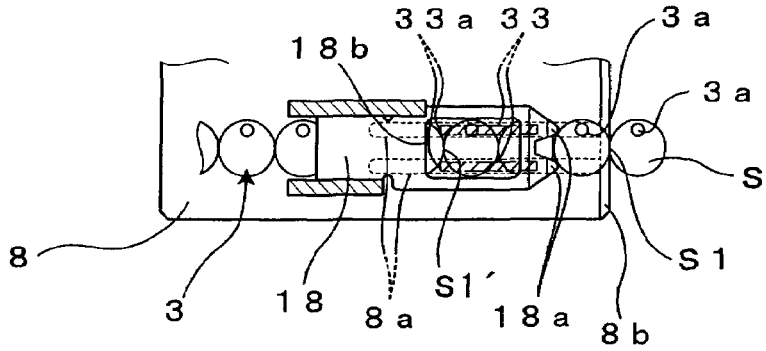

FIG. 2 is a side view showing in enlarged scale a part of one of the sequin sewing units 1. As illustrated in FIG. 2, the sequin sewing unit 1 also includes a mounting base 4, on which are supported the reel 5 having a continuous sequin strip 3 wound thereon and a sequin feeder apparatus 6. The mounting base 4 is mounted via a not-shown link mechanism in such a manner that it can ascend and descend relative to the needle bar case 2. FIG. 3 is a side view showing in enlarged scale the sequin feeder apparatus 6 employed in the sequin sewing unit 1. FIG. 4 is a perspective view showing in enlarged scale relevant sections of a sequin feed mechanism of the sequin feeder apparatus 6. FIG. 5(*a*) is a partially-sectional side view of the sequin feed mechanism of the sequin feeder apparatus 6, and FIG. 5(*b*) is a schematic plan view showing in more detail the sequin feed mechanism shown in FIG. 5(*a*). In FIGS. 2 and 3, the mounting base 4 is shown as being in a descended or lowered position and in a position to permit sewing of a sequin. On the other hand, when sewing of a sequin is not to be performed, the mounting base 4 is evacuated to an ascended or raised position so as not to hinder the normal embroidering operation. In the individual machine heads, the mounting bases 4 are driven to ascend or descend concurrently via not-shown air cylinders. Where the embroidery sewing machine has a smaller number of the machine heads as in a single-head embroidery sewing machine, the mounting base (or bases) 4 may be caused to ascend or descend through manual operation by a human operator.

Figure 14A:
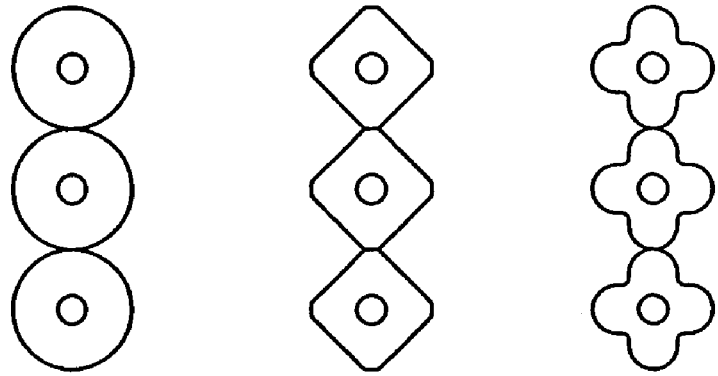
FIG. 14 is a plan view showing various types of conventionally-known sequins.
Figure 14B:
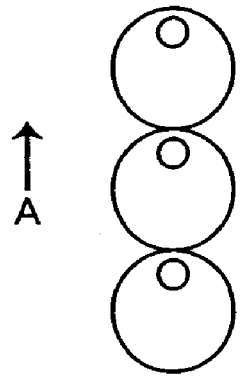
Figure 14C:
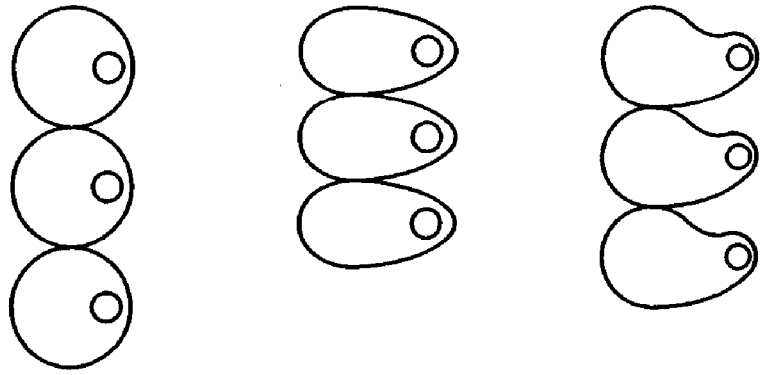

The aforementioned reel 5 having the continuous sequin strip 3 wound thereon is rotatably and removably attached to an upper end portion of an arm section 4*a* formed on an upper portion of the mounting base 4. The continuous sequin strip 3 is let out or played out from the reel 5 to the sequin feeder apparatus 6. The continuous sequin strip 3 is formed, for example, by die-cutting a synthetic resin film of a given width into a multiplicity of generally circular sequins S continuously connected together via connecting portions S1 (see FIG. 4). In the instant embodiment, the strip 3 is a strip of continuously-connected sequins S each having a sewing hole (needle passing hole) 3*a* offset from center of the sequin in a direction perpendicular to the sequin feeding direction as illustrated in FIG. 14(*c*).

Next, an example construction of the sequin feeder apparatus 6 will be explained in detail.

The sequin feeder apparatus 6 is secured to a support plate 7 that is in turn attached to a lower end portion of the mounting base 4. The support plate 7 has a horizontal sequin supporting plate 8 formed on its lower end for supporting thereon sequins. Portion of the continuous sequin strip 3, paid out or let out from the reel 5, is directed downward along the mounting base 4 via a tension roller 45 and orientation roller 46 (see FIG. 2), led onto the supporting plate 8 by way of a guide section 12 (see FIGS. 2 and 3) provided on the rear surface of a bracket 11, and then delivered rearward as viewed from the front of the embroidery sewing machine. Note that, in the following description about the sequin sewing unit 1, the terms "forward" and "reward" are used to refer to directions opposite to the forward and rearward directions of the embroidery sewing machine, for convenience of explanation. Namely, the direction in which sequins are fed out (.e., in a rearward direction as viewed from the front of the embroidery machine, or rightward in FIG. 2) will hereinafter referred to as "forward direction".

As illustrated in FIG. 3, a pivot shaft 15 is pivotally supported on a middle portion of the support plate 7 with the axial centerline of the pivot shaft 15 extending in the left-right direction (i.e., X direction in FIG. 1). Pivot lever 16 is fixed via a screw 17 to the pivot shaft 15, and a feed lever 18 is pivotably supported, via a shaft 19, on a free end portion of the pivot lever 16. Further, a follower lever 20 is fixed via a screw 21 to the pivot shaft 15. Consequently, the follower lever 20 and pivot lever 16 are integrally connected together to provide a "bellcrank-like" structure. Torsion spring 22 fitted around the pivot shaft 15 has one end secured to the support plate 7 and the other end held on the follower lever 20, so that the pivot lever 16 is normally biased in a counterclockwise direction of FIG. 3 by the biasing force of the torsion spring 22. Torsion spring 23, which is fitted around the shaft 19, has one end secured to the pivot lever 16 and the other end held on the feed lever 18. Thus, the feed lever 18 is normally biased in the clockwise direction about the shaft 19 in such a manner that its distal end is normally biased toward the supporting plate 8.

As illustrated in FIGS. 4 and 5, the feed lever 18 has, at its distal end, two engaging portions 18*a* (see FIG. 5(*b*)). The feed lever 18 functions to feed the continuous sequin strip 3 in the forward direction at a predetermined pitch by being moved forward with the engaging portions 18*a* abutting against a rear outer peripheral edge portion of a predetermined one of the sequins S of the sequin strip 3 placed on the supporting plate 8. As will be later detailed, the feed lever 18 is moved forward and rearward in response to pivotal movement of the pivot lever 16, so as to sequentially feed the continuous sequin strip 3 forward by the predetermined pitch at a time. The pivot lever 16 and mechanism for pivoting the pivot lever 16 together constitute a feed mechanism for moving the feed lever 18 in the forward and rearward directions.

As seen in FIG. 3, the above-mentioned follower lever 20 integrally connected with the pivot lever 16 has a free end connected to a free end of a driving lever 38 via a connection link 37. The driving lever 38 is fixedly connected to an output shaft 40 of a motor 36 that is in turn secured to the left side surface of the mounting base 4. By the motor 36 driving the driving lever 38 to reciprocatively pivot through a predetermined angular range, the pivot lever 16 is caused to pivot via the connection link 37 and follower lever 20, and the feed lever 18 is driven to move forward and rearward, in response to the pivoting movement of the pivot lever 16, so that the continuous sequin strip 3 can be fed forward in a predetermined manner. In the instant embodiment, where the predetermined sequin S is fed out by the engaging portions 18*a*, provided at the distal end of the feed lever 18, abutting against the rear outer peripheral edge portion of the sequin S, it is possible to feed out, at the predetermined pitch, sequins S each having a sewing hole eccentrically displaced or offset from the center of the sequin in a direction perpendicular to the sequin feeding direction.

The supporting plate 8 has two slits 8*a* provided in corresponding relation to the two engaging portions 18*a* of the feed lever 18, and each of the two slits 8*a* has an appropriate width and extends from a given front position to a central position of the plate 8 in the front-to-rear (Y) direction. These slits 8*a* of the supporting plate 8 are provided to allow the engaging portions of the feed lever 18 and engaging claws 33*a* of a later-described lock lever 33 to bite into predetermined sequins S. Further, a fixed cutter blade 8*b* for cutting the sequin strip 3 into individual sequins S in conjunction with a movable cutter blade 27 is formed on the front end edge of the supporting plate 8.

The pivot lever 16, normally biased in the counterclockwise direction via the torsion spring 22, is held in a posture as illustrated in FIGS. 3, 4 and 5 by abutting against a stopper 25 provided on the support plate 7. The posture of the pivot lever 16 shown in FIGS. 3-5 is taken when operation for feeding out one sequin (i.e., one sequin-feeding cycle) has been completed as will be later described. The stopper 25 is in the form of a threaded rod screwed to a bracket 26 secured to the support plate 7. The pivot lever 16 abuts against the rear end of the stopper 25. The stopper 25 is locked by screwing up of a nut.

Guide member 12 for directing the continuous sequin strip 3 onto the supporting plate 8 comprises two guide members 12*a*, each of which may be made by bending a plate into a channel-like sectional shape. The guide section 12 is replaceable with another one depending on the width of the continuous sequin strip 3 set on the feeder apparatus. Distance between opposed side walls of each of the guide members 12*a* is set slightly greater than the width of each sequin S of the set strip 3. Holding member 44 is disposed in front of the bracket 11 having the guide section 12 attached thereto. The holding member 44 is in the form of a resilient plate, such as a spring steel plate, which has a width equal to or slightly greater than the width of the sequin S and has a predetermined length. The holding member 44 has one end portion secured to the bracket 11 and the other end portion resiliently abutted against the upper surface of the supporting plate 8, with an intermediate portion of the holding member 44 being bent arcuately. The continuous sequin strip 3, delivered onto the supporting plate 8 via the guide section 12, is passed between the supporting plate 8 and the holding member 44 resiliently abutted against the upper surface of the supporting plate 8.

Next, a description will be given about the lock lever 33 disposed above the feed lever 18 and a mechanism for driving the lock lever 33.

As seen in FIGS. 3, 4 and 5, the lock lever 33 is disposed above the feed lever 18. Intermediate portion of the lock lever 33 is pivotably supported, via a pin 39, provided on a support block 35 that is in turn fixed to the support plate 7. As shown in FIG. 4, the lock lever 33 comprises two levers formed integrally thereon, and one of the levers (the inner lever in FIG. 4, i.e. the lever shown in FIG. 5(*a*)) of the lock lever 33 has, at its one end, the engaging claws 33*a* engageable with the slit 8*a* of the supporting plate 8 and has, at the other end, a stopper portion 33*b*. The other lever (the outer lever in FIG. 4) of the lock lever 33 only has, at its one end, the engaging claws 33*a* engageable with the slit 8*a* of the supporting plate 8. In other words, the lock lever 33 has two engaging claws 33*a* corresponding to the two slits 8*a* of the supporting plate 8, and the stopper portion 33*b*. In FIG. 4, the support block 35 is shown with its front portion taken away to allow the lock lever 33 to be visible more easily. Each of the engaging claws 33*a* of the lock lever 33 extends through a through-hole 18*b* formed in the feed lever 18, and a torsion spring (not shown) is provided on the pin 39 fixed to the support block 35. The lock lever 33 is normally biased, by that torsion spring, against the support block 35 in the counterclockwise direction of the figure and the stopper portion 33*b* of the thus-biased lock lever 33 abuts against a stopper portion 35*a* of the support block 35, so that the lock lever 33 in its free state is held in a posture or position where the end edges of the two engaging claws 33*a* confront the two slits 8*a* of the supporting plate 8. In this state, the end edges of the two engaging claws 33*a* of the lock lever 33 are located at a portion (indicated at S1 in FIG. 5(*b*), for convenience of explanation) between fourth and fifth sequins S from the leading end of the sequin strip 3 and abut against a rear peripheral region of the fourth sequin S and a front peripheral region of the fifth sequin S, to thereby immovably lock the sequin strip 3.

As will be later described in detail, the edge of the through-hole 18*b* in the feed lever 18 abuts against the lock lever 33, during rearward or retracting movement of the feed lever 18, to pivot the lock lever 33 in the clockwise direction against the counterclockwise biasing force of the torsion spring acting on the lock lever 33. In this way, the engaging claw 33*a* is moved upwardly to disengage the peripheral regions of the sequins S.

The support block 35 supporting the lock lever 33 is adjustable in its position, in the front-rear direction (i.e., feeding direction of the continuous sequin strip 3 on the supporting plate 8), relative to the support plate 7. Thus, the position at which the two engaging claws 33*a* of the lock lever 33 engage the sequins S can be adjusted in accordance with the size of the sequins S. Note that the support plate 7 too is adjustable in its position, in the front-rear direction (i.e., feeding direction of the continuous sequin strip 3 on the supporting plate 8), relative to the mounting base 4.

As clear from FIGS. 3 and 4, the movable cutter blade 27 is pivotably supported, via a pin 28, on a lower end portion of the support plate 7, and the movable cutter blade 27 is normally held, by a torsion spring 30, in an evacuated or retracted posture in a position spaced upward from the fixed cutter blade 8*b* that is provided on the front edge of the supporting plate 8. The movable cutter blade 27 has a small-thickness distal end portion 27*a*, and an upper region u of the distal end portion 27*a* of the movable cutter blade 27 is recessed obliquely downward so that a large-thickness body portion 27*b* of the blade 27 forms an uppermost portion T of the blade 27 when the movable cutter blade 27 is in its retracted position. As a needle bar 31 descends, the movable cutter blade 27 is depressed by a needle clamp 32 to pivot against the resilient biasing force of the torsion sprint 30, so that the movable cutter blade 27 can cut the strip 3 across the connecting portion S1 of a predetermined sequin S in conjunction with the fixed cutter blade 8*b*. At that time, the descending needle clamp 32 will come into abutting contact with the large-thickness body portion 27*b* because the upper region u of the distal end portion 27*a* of the movable cutter blade 27 is recessed obliquely downward to allow the large-thickness body portion 27*b* to become the uppermost portion T. Thus, it is possible to prevent the inconvenience that the descending needle clamp 32 abuts against and damages the small-thickness end portion 27*a* of a relatively small mechanical strength. As the needle clamp 32 ascends along with the needle bar 31, the movable cutter blade 27 returns to its retraced position by the resilient restoring force of the torsion spring 30.

The following paragraphs describe the sequin feeding operation performed in the embodiment of the present invention, with primary reference to FIGS. 5-9 showing an example operational sequence of the sequin feeding operation. FIGS. 6-9 are views explanatory of the sequin feeding operation, which particularly show various states or phases of the sequin feeding operation in partly-sectional side views and schematic plan views similarly to FIG. 5.

FIGS. 5(*a*) and (*b*) show a state at a time point when one sequin feeding operation cycle has been completed. When one sequin feeding operation cycle has been completed, the two engaging portions 18*a* of the feed lever 18 are in abutment against a rear peripheral region of the second sequin S from the leading end of the continuous sequin strip 3, as shown in FIG. 5(*b*). In this state, the first or leading sequin S of the continuous sequin strip 3 projects forward beyond the supporting plate 8, and the connecting portion S1 between the leading sequin S and the second sequin is positioned in vertical alignment with the cutting edge of the fixed cutter blade 8*b*. Also, in this state, the engaging claws 33*a* of the lock lever 33 are in abutment against a rear peripheral region of the second sequin from the above-mentioned second sequin S (i.e., fourth sequin from the leading end of the continuous sequin strip 3) and a front peripheral region of the third sequin from the above-mentioned second sequin (i.e., fifth sequin from the leading end of the continuous sequin strip 3).

After the completion of one sequin feeding operation cycle, the next sequin sewing operation is carried out in the following manner as the needle bar 31 descends. First, a sewing needle 41 provided at the lower end of the needle bar 31 fits into the sewing hole 3*a* of the leading sequin S of the sequin strip 3. Then, the movable cutter blade 27 is depressed by the descending movement of the needle clamp 32, so that the sequin strip 3 is cut in the connecting portion S1 through the cooperative cutting operation of the movable and fixed cutter blades 27 and 8*b*, and thus, the leading sequin S is severed from the sequin strip 3. Then, the thus-severed sequin S falls onto an embroidering (i.e., to-be-embroidered) cloth or fabric W (FIG. 3) with the sewing needle 41 still kept fit in the sewing hole 3*a* of the severed sequin S, after which the sequin S is sewn onto the embroidering fabric W through controlled movement of the embroidery frame holding the embroidering fabric W and vertical or up-and-down movement of the needle bar 31.

Figure 6A:
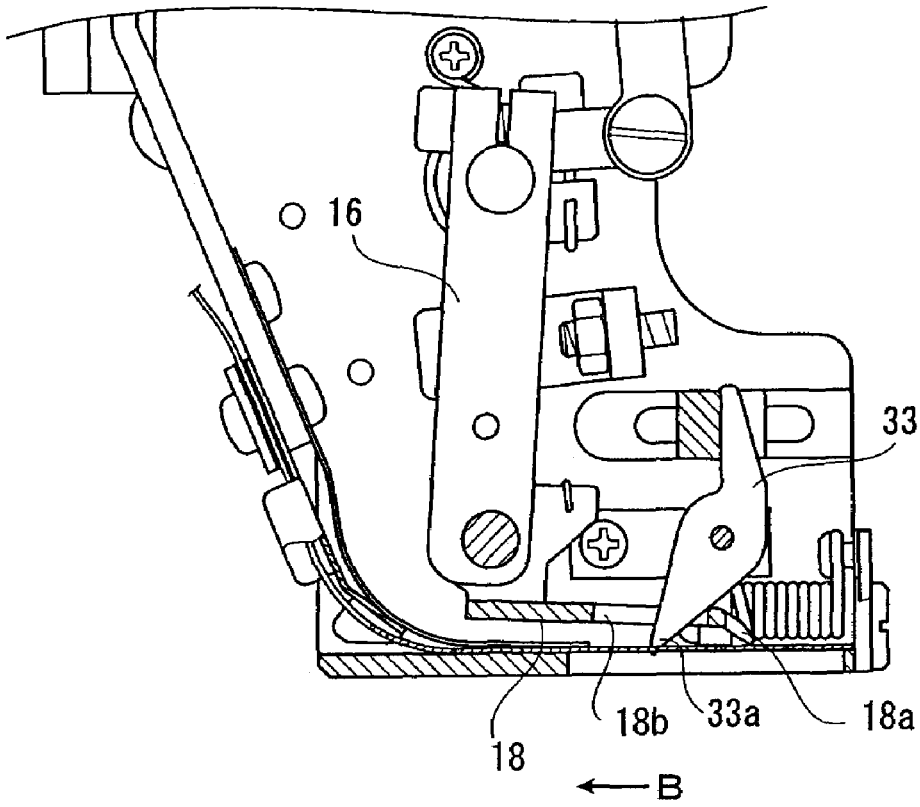
FIG. 6 is a view explanatory of sequin feeding operation, where (a) is a partly-sectional side view showing a state at a time point immediately after two engaging portions of the feed lever have disengaged from a peripheral region of a sequin during retracting movement of the feed lever and (b) is a schematic plan view of the sequin feeder apparatus in that state.
Figure 6B:
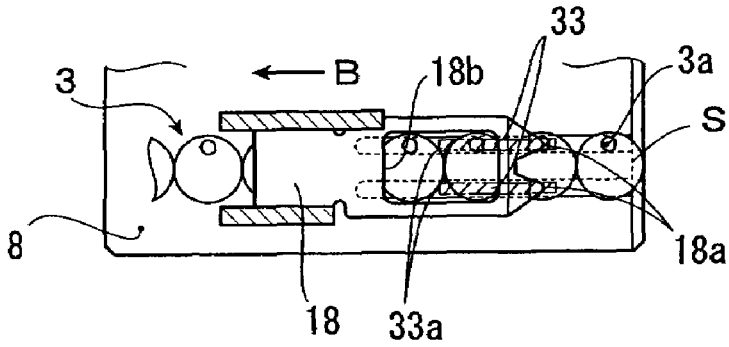

Then, the pivot lever 16 is pivoted in the clockwise direction via the motor 36, so that the feed lever 18 moves rearward or retracts. FIGS. 6(*a*) and (*b*) shows the feed lever 18 having started its retracting movement with a front inner edge portion of the through-hole 18*b* abutting against the two engaging claws 33*a* of the lock lever 33, and the retracting direction is indicated by arrow B. As the feed lever 18 further retracts from the position indicated in FIGS. 6(*a*) and (*b*), the lock lever 33 pivots clockwise, through its engagement with the inner edge of the through-hole 18*b*, against the resilient biasing force of the not-shown torsion spring, so that the engaging claws 33*a* of the lock lever 33 moves upward from the sequin S out of the abutting engagement with the peripheral region of the sequin S. As the feed lever 18 shifts from the position of FIG. 5 to the position of FIG. 6, the two engaging portions 18*a* of the feed lever 18 run onto the upper surface of the second sequin S from the leading end. Because, at that time, the two engaging claws 33*a* of the lock lever 33 are still kept abutting against two points of the peripheral region of the sequin S, it is possible to reliably prevent undesired displacement of the continuous sequin strip 3 when the two engaging portions 18*a* of the feed lever 18 run onto of the second sequin S.

Figure 7A:
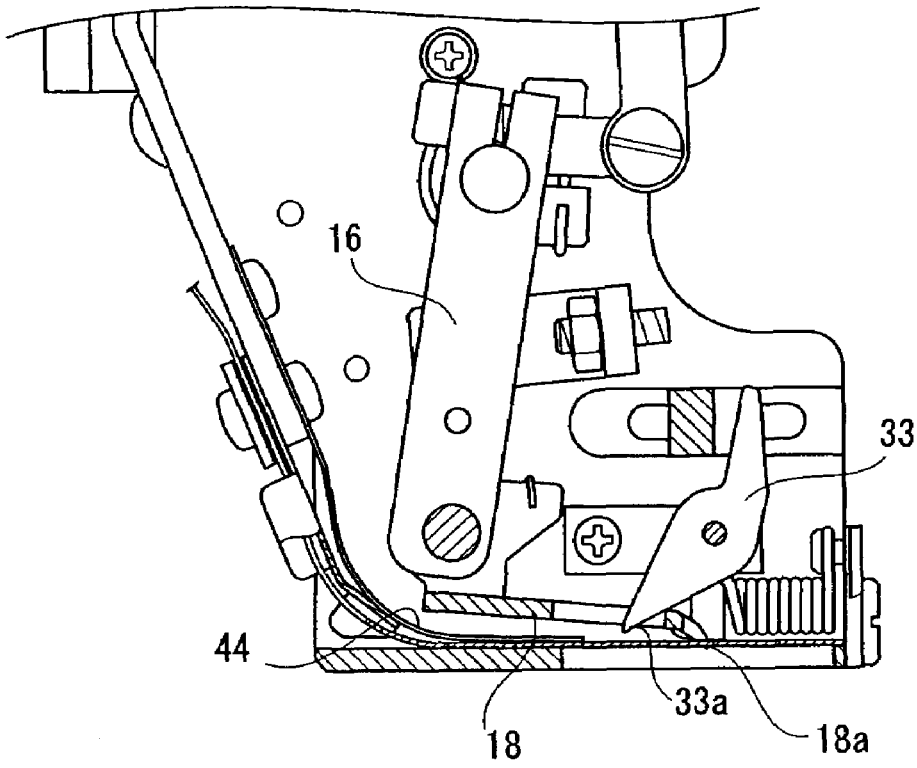
FIG. 7 is a view explanatory of the sequin feeding operation, where (a) is a partly-sectional side view showing a state at a time point when the feed lever has retracted to the rearwardmost position and (b) is a schematic plan view of the sequin feeder apparatus in that state.
Figure 7B:
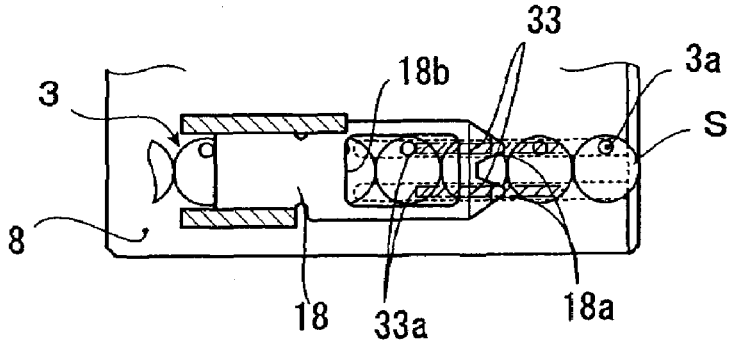

FIGS. 7(*a*) and (*b*) show the feed lever 18 having retracted to its rearwardmost position. One of the engaging portions 18*a* of the feed lever 18, which was located over the sewing hole 3*a* of the sequin S in the aforementioned state of FIG. 6, passes over the sewing hole 3*a* during a shift from the position of FIG. 6 to the position of FIG. 7. During the positional shift from the position of FIG. 6 to the position of FIG. 7, the continuous sequin strip 3, where the engagement, by the two engaging claws 33*a* of the lock lever 33, of the peripheral region of the sequin S was canceled, can be prevented from retracting together with the retracting movement of the feed lever 18, because the retracting movement of the continuous sequin strip 3 is constantly prevented by the resilient biasing force of the holding member 44.

Figure 8A:
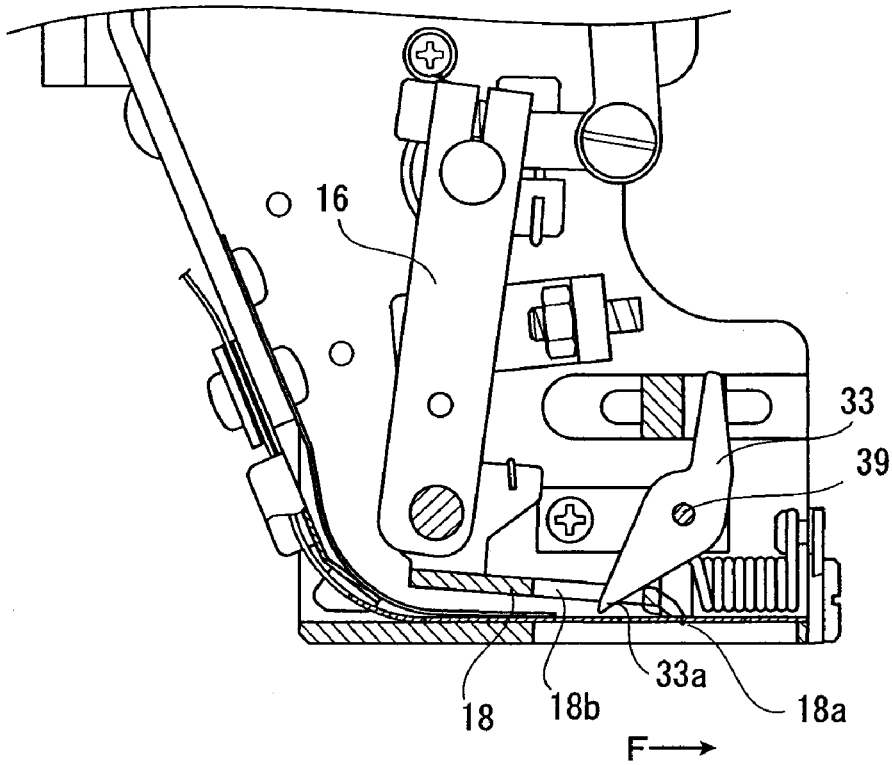
FIG. 8 is a view explanatory of the sequin feeding operation, where (a) is a partly-sectional side view showing a state at a time point when the engaging portions of the feed lever have engaged (abutted against) a peripheral region of a sequin during advancing movement of the feed lever and (b) is a schematic plan view of the sequin feeder apparatus in that state.
Figure 8B:
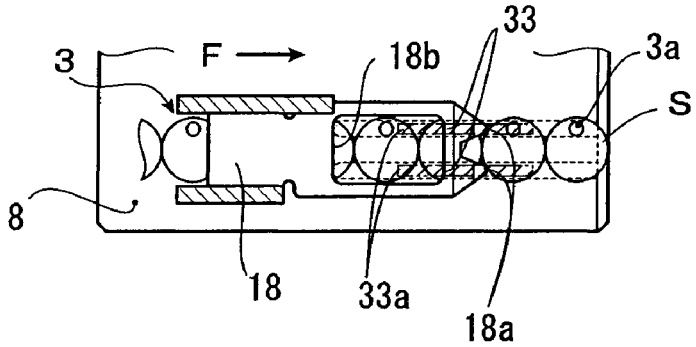
Figure 9A:
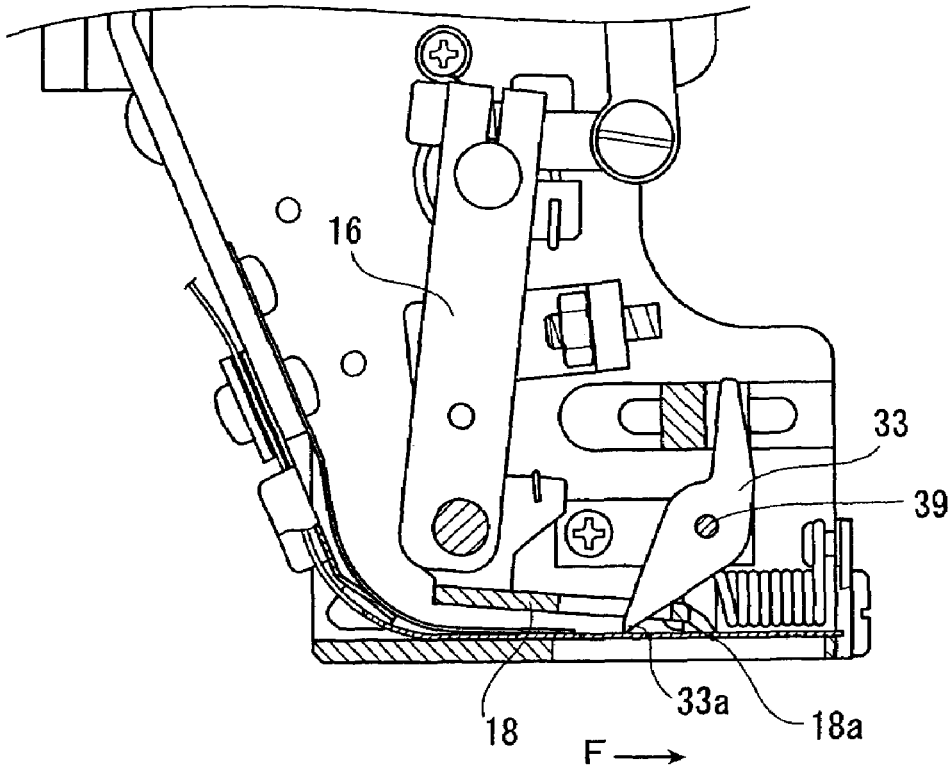
FIG. 9 is a view explanatory of the sequin feeding operation, where (a) is a partly-sectional side view showing a state at a time point when the inner edge of a through-hole of the advancing feed lever is just about to disengage from a lock lever and (b) is a schematic plan view of the sequin feeder apparatus in that state.
Figure 9B:
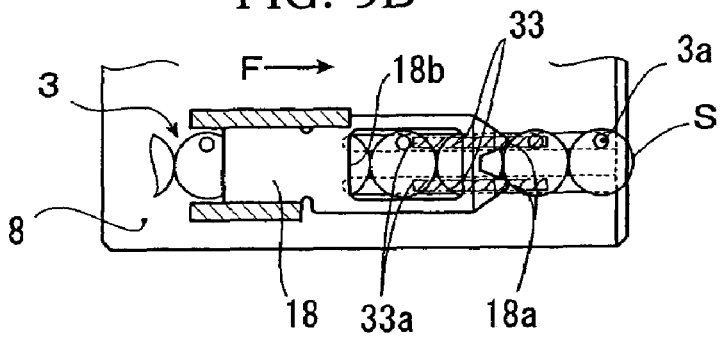

Then, the pivot lever 16 is caused to pivot counterclockwise by the reverse rotation of the motor 36, so that the feed lever 18 advances to the position shown in FIG. 5. FIGS. 8 and 9 show a state transition during the advancing movement of the feed lever 18. FIGS. 8(*a*) and (*b*) show a state when the two engaging portions 18*a* of the feed lever 18 have abutted against a rear peripheral region of the sequin S. The continuous sequin strip 3 is fed out by subsequent advancing movement of the feed lever 18. Further, FIGS. 9(*a*) and (*b*) show a state at a time point when the inner edge of the through-hole 18*b* of the advancing feed lever 18 is just about to disengage from the lock lever 33. In FIGS. 8 and 9, the advancing direction of the feed lever 18 is indicated by arrow F. Once the lock lever 33 is caused to pivot counterclockwise by the biasing force of the torsion spring provided on the above-mentioned pin 39 in response to the disengagement, from the inner edge of the through-hole 18*b* of the advancing feed lever 18, the two engaging claws 33*a* of the lock lever 33 comes to resiliently abut against the upper surface of the sequin S. Then, as the feed lever 18 further advances, the two engaging claws 33*a* of the lock lever 33 slide relative to the upper surface of the sequin S. Then, as the feed lever 18 reaches the feed-out completion position shown in FIG. 5, the two engaging claws 33*a* of the lock lever 33 abut against a rear peripheral region of the sequin as noted above.

When the motor 36 is in the non-energized or OFF state, e.g. when the power supply to the embroidery sewing machine is OFF, the pivot lever 16 is held in the feed-out completion position shown in FIG. 5, by virtue of the resilient force of the torsion spring 22 on the pivot lever 16, so that the lever 16 is held in abutment against the stopper 25. The motor 36 is a pulse motor that operates under open control, so that it may lose appropriate synchronization if an excessive force acts on the motor 36 during the feed control. For that reason, the motor 36 in the embodiment is temporarily deenergized when the feed lever 18 has reached the forwardmost position, i.e. when the pivot lever 16 has abutted against the stopper 25 upon completion of the feeding cycle. Thus, the motor 36 can be restored to the zero point without fail even when it has lost synchronization; in this way, it is possible to prevent accumulation of displacement caused by the synchronization loss.

The following paragraphs describe an example manner in which the various components of the sequin feeder apparatus are adjusted when the reel 5 is replaced with another one so that the sequins S to be sewn onto the embroidering fabric are switched over to sequins differing in size from the previous sequins. The adjustments of the components, as set forth in items (1)-(4) below, may be performed concurrently, or sequentially, in any appropriate order.

(1) Adjustment of Sequin Feed Pitch:

In order to adjust the sequin feed pitch, the screw 17 (see FIG. 3) fastening the pivot lever 16 is loosened so that the pivot lever 16 can be readily turned with a hand relative to the pivot shaft 15. Further, the stopper 25 is unlocked, and the continuous sequin strip 3 is played out from the reel 5 onto the supporting plate 8 so that the leading sequin S of the strip 3 projects beyond the front end edge of the supporting plate 8 as in the "feed-out completion position" shown in (b) of FIG. 5. Also, the pivot lever 16 and feed lever 18 are manually operated to cause the two engaging portions 18*a* of the feed lever 18 to engage the sewing hole 3*a* of the second sequin from the leading sequin of the strip 3. Then, the stopper 25 is again locked and the screw 17 is tightened with the feed mechanism, including the pivot lever 16 and feed lever 18, adjusted into the "feed-out completion position" in accordance with the size of the changed sequin (i.e., newly-set sequin) S.

(2) Adjustment of Lock Lever:

To adjust the lock lever 33, first, the support block 35 is unlocked. Then, the position, in the front-rear direction, of the support block 35 is adjusted manually to adjust the position of the lock lever 33 so that the engaging claws 33*a* of the lock lever 33 engage a rear peripheral region of a predetermined sequin S (second sequin S from the sequin S engaged by the engaging portions 18*a*, i.e. fourth sequin S from the leading end of the sequin strip 3), as illustrated in FIG. 5, with the stopper portion 33*b* provided at the upper end of the lock lever 33 abutting against the stopper portion 35*a* of the support block 35. Thus, as indicated in the "feed-out completion position" of FIG. 5(*b*), the support block 35 is locked with the lock lever 33 appropriately adjusted so that the engaging claws 33*a* of the lock lever 33 engage the rear peripheral region of the predetermined sequin S.

(3) Positional Adjustment of Sequin's Sewing Hole Relative to Sewing Needle Position:

Positional adjustment of the sewing needle 41 and the sewing hole 3*a* of the sequin S is carried out by adjusting the position of the support plate 7 relative to the mounting base 4. The support plate 7 is mounted to the guide members, extending and functioning in the front-rear direction, in such a manner that it is adjustable in position in the front-rear direction, and the guide members are mounted to the mounting base 4 in such a manner that they are adjustable in position in the left-right direction. Thus, it is only necessary that a lock provided in connection with the guide members be brought into an unlocking position so as to allow the support plate 7 to be manually moved in the front-rear direction relative to the mounting base 4. Then, the support plate 7 is adjusted so that the center of the sewing hole 3*a* of the sequin S, having been delivered from the supporting plate 8 to a position where the connecting portion S1 vertically aligns with the cutting edge of the fixed cutter blade 8*b*, is located in vertical alignment with the center of the sewing needle 41. Upon completion of such adjustment, the guide members and support plate 7 are again locked and fixed to the mounting base 4. Because the support plate 7 is adjustable in position relative to the mounting base 4 not only in the front-rear direction but also in the left-right direction in the aforementioned manner, the instant embodiment permits appropriate positional adjustment of the sewing hole relative to the sewing needle even where the sequin is of the type where the sewing hole is offset from the center of the sequin in the direction perpendicular to the sequin feeding direction.

(4) Replacement of Guide Section:

As necessary, the guide section 12, mounted on the bracket 11, may be replaced with another one that corresponds to the width of a changed sequin (i.e., sequin newly set on the apparatus) S.

According to the instant embodiment of the invention, as described above, the feed lever 18 has two engaging portions 18*a* at its distal end, and it causes the engaging portions 18*a* to abut against a peripheral region of a predetermined sequin S to thereby feed the continuous sequin strip 3. Thus, even for sequins S each having the sewing hole 3*a* offset from the sequin center, the feed lever 18 can reliably feed each of the sequins S at a predetermined pitch (i.e., distance between adjoining connecting portions S1) without producing a force rotating the sequin generally about the connecting portion and hence with no unwanted inclination (about the vertical axis) of the sequin due to deformation of the connecting portion. Needless to say, the sequin feeder apparatus 6 arranged in the above-described manner can reliably feed out ordinary sequins S, each having the sewing hole 3*a* in the sequin center, at a predetermined pitch, in addition to sequins S each having the sewing hole 3*a* offset from the sequin center.

Figure 10A:
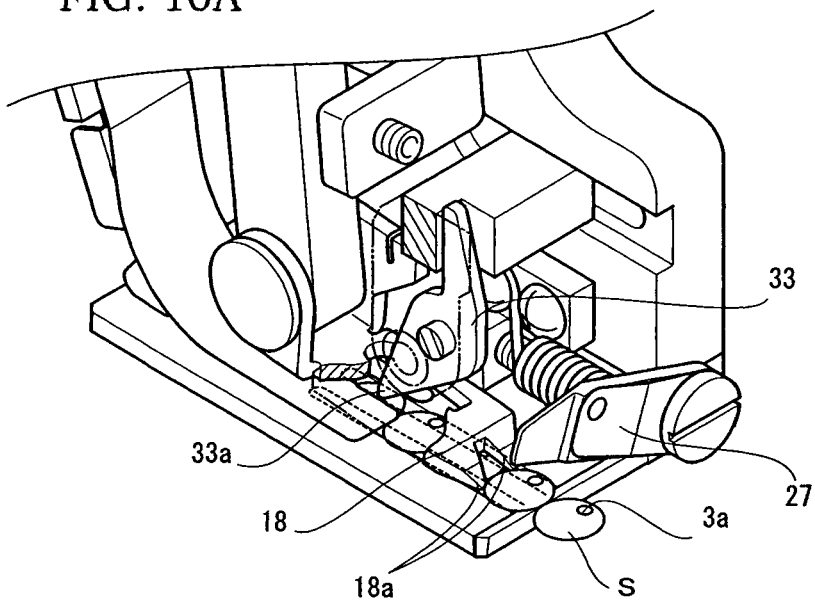
FIG. 10 is a view showing a modification of the sequin feeder apparatus including a modified lock lever having only one engaging claw, where (a) is a partly-broken-away perspective view of a relevant section of the sequin feeder apparatus, (b) is a partly-sectional side view of the relevant section of the sequin feeder apparatus and (c) is a schematic plan view of the relevant section.
Figure 10B:
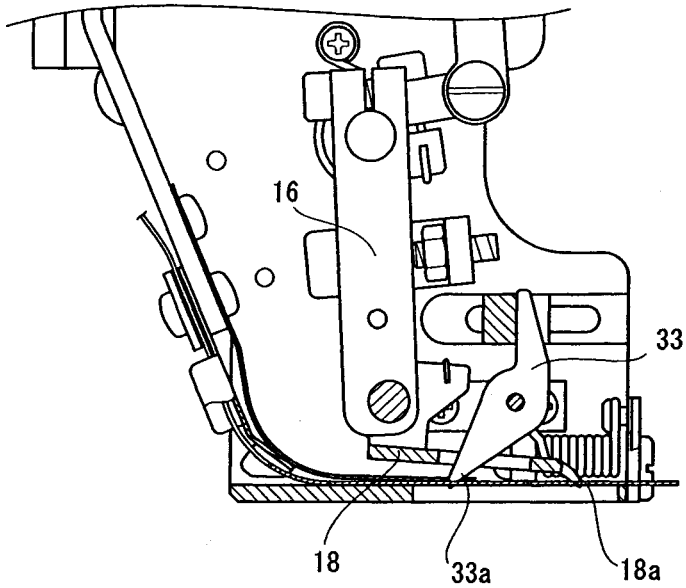
Figure 10C:
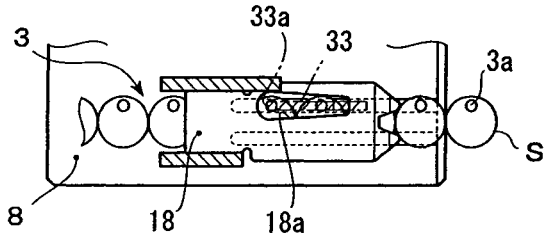

According to the above-described instant embodiment, the lock lever 33 integrally has two engaging claws 33*a* at its tip, and these engaging claws 33*a* are caused to abut against a peripheral region of a sequin S. FIGS. 10(*a*)-(*c*) show a modification of the feeder apparatus 6 including a modified lock lever 33 having only one engaging claw 33*a*. More specifically, FIG. 10(*a*) is a partly-broken-away perspective view of a relevant section of the sequin feeder apparatus, (b) is a partly-sectional side view of the relevant section of the sequin feeder apparatus, and (c) is a schematic plan view of the relevant section. In the illustrated example, the modified lock lever 33 is a lever having an engaging claw 33*a* at its distal end and a stopper portion 33*b* at the other end. Namely, even where the lock lever 33 has only one engaging claw 33*a*, the present invention can be implemented appropriately by causing the engaging claw 33*a* to abut against (engage) a rear peripheral region of a sequin S. Because, in the illustrated example, the sewing hole 3*a* of each sequin S is located at a position corresponding to the engaging claw 33*a*, the engaging claw 33*a* may be caused to engage the sewing hole 3*a*.

Figure 11A:
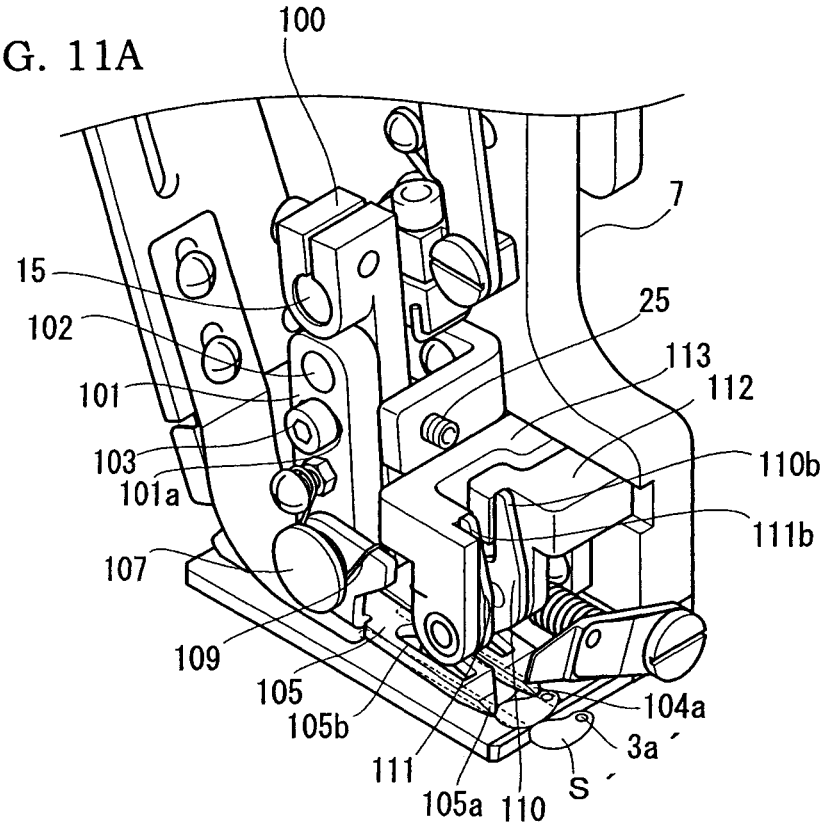
FIG. 11(*a*) is a perspective view showing another modification of the sequin feeder apparatus, and FIG. 11(*b*) is a view of the sequin feeder apparatus with part of the lock lever taken away.
Figure 11B:
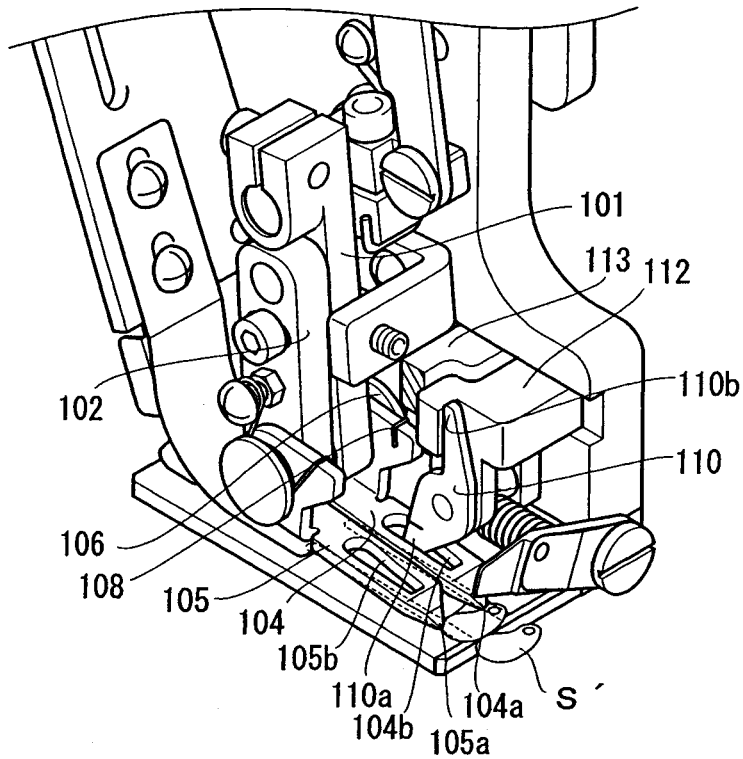
Figure 12A:
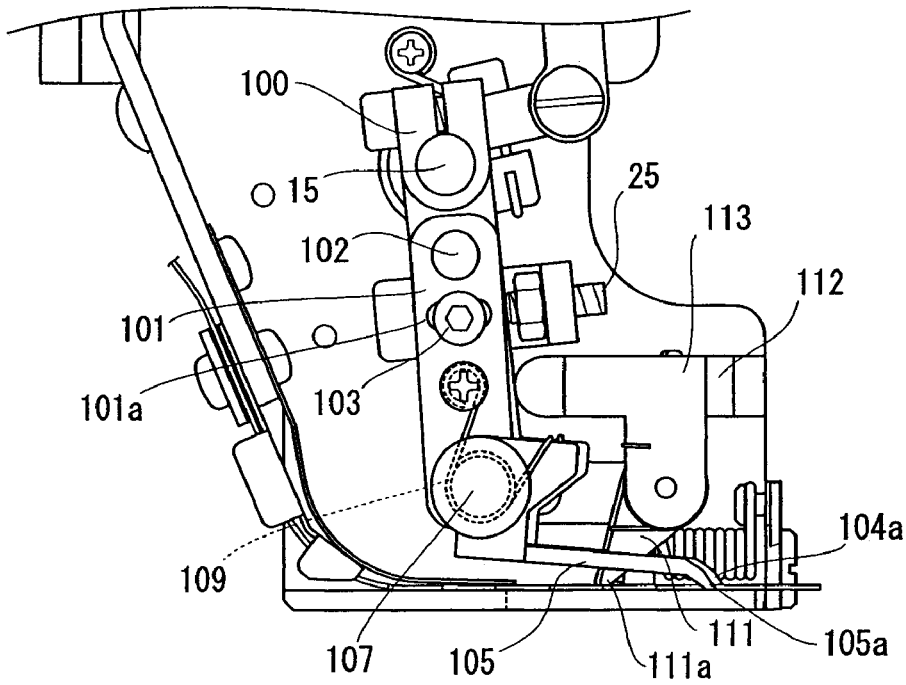
FIG. 12(*a*) is a side view of the sequin feeder apparatus shown in FIG. 11, and FIG. 12(*b*) is a schematic plan view of the sequin feeder apparatus.
Figure 12B:
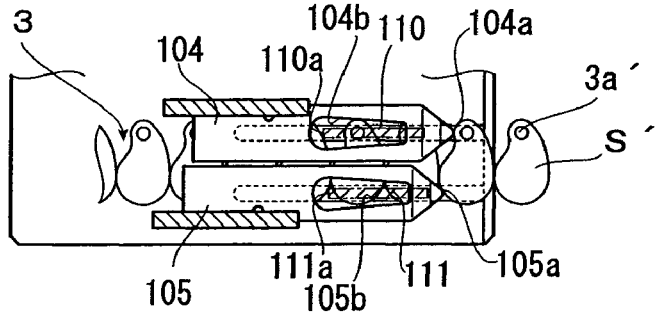

Further, according to the above-described instant embodiment of the sequin feeder apparatus 6, the single feed lever 18 has the two engaging portions at its distal end. FIGS. 11 and 12 show a modification of the sequin feeder apparatus 6 including a modified feed lever 18 having only one engaging portion. More specifically, FIG. 11(*a*) is an enlarged perspective view of a relevant section of the modification of the sequin feeder apparatus 6, and (b) is a perspective view of the relevant section of the sequin feeder apparatus with part of the lock lever 33 taken away. Further, FIG. 12(*a*) is a side view of the sequin feeder apparatus 6 shown in FIG. 11, and (b) is a schematic plan view of the sequin feeder apparatus 6. As clearly seen from FIGS. 11 and 12, a first pivot arm 100 is fixed to the pivot shaft 15, and a second pivot arm 101 is pivotally connected to the first pivot arm 100 via a shaft 102. Namely, the second pivot arm 101 is pivotally connected to the shaft 102 connected to the first pivot arm 100 and can be fixed to the first pivot arm 100 by means of a fastening screw 103. The fastening screw 103 is fitted in an elongated hole 101*a* formed in the second pivot arm 101. The elongated hole 101*a* is an arcuate hole formed along an imaginary circular line drawn about the shaft 102. Thus, by loosening the fastening screw 103, the second pivot arm 101 is allowed to pivot about the shaft 102 and along the arcuate elongated hole 102. Then, by tightening the fastening screw 103 when the second pivot arm 101 is at a desired pivotal position, the pivotal position of the second pivot arm 101 relative to the first pivot arm 100 can be adjusted as desired.

Further, first and second feed levers 104 and 105, having first and second engaging portions 104*a* and 105*a* at their respective distal ends, are pivotably supported, via shafts 106 and 107, on the free ends of the first and second pivot arms 100 and 101, respectively. Torsion springs 108 and 109 are fitted over the shafts 106 and 107, so that the two feed levers 104 and 105 are normally urged clockwise by the torsion springs 108 and 109. First and second lock levers 110 and 111 are provided over the feed levers 104 and 105, respectively. Further, the first and second lock levers 110 and 111 have engaging claws 110*a* and 111*a* at their respective distal ends and stopper portions 110*b* and 111*b* at their respective other ends, and the first and second lock levers 110 and 111 are pivotably supported at their respective middle portions by first and second support blocks 112 and 113 mounted on the support plate 7. The engaging claws 110*a* and 111*a* of the two lock levers 110 and 111 extend through through-holes 104*b* and 105*b*, respectively, formed in the feed levers 104 and 105. Note that the two lock levers 110 and 111 are normally urged counterclockwise by not-shown torsion springs.

According to this modified embodiment, the position of the second feed lever 105 relative to the first feed lever 104 can be adjusted by adjustment of the pivotal position of the second pivot arm 101 relative to the first pivot arm 100. Thus, the position of the second engaging portion 105*a* relative to the first engaging portion 104*a* can be adjusted. Further, by adjusting the positions of the two support blocks 112 and 113, it is possible to adjust the positions of the two lock levers 110 and 111 in accordance with the positions of the respective feed levers 104 and 105. Thus, even where the peripheral position of the sequin S to be engaged or abutted against differs between the engaging portions 104*a* and 105*a* as in the case of the sequins S' shown in FIGS. 11 and 12, appropriately adjusting the relative positions of the engaging portions 104*a* and 105*a* allows the engaging portions 104*a* and 105*a* to reliably engage a peripheral region of a sequin; thus, this embodiment can accurately feed out a sequin without any unnecessary force acting on the sequin to rotate the sequin generally about the neighborhood of the connecting portion of the sequin. Further, according to this embodiment, it is also possible to cause the first engaging portion 104*a* to engage the sewing hole 3*a*' of the sequin S' and cause the second engaging portion 105*a* to abut against a peripheral region of the sequin S', which thereby permits more reliable feed-out of the sequin.

Figure 13:
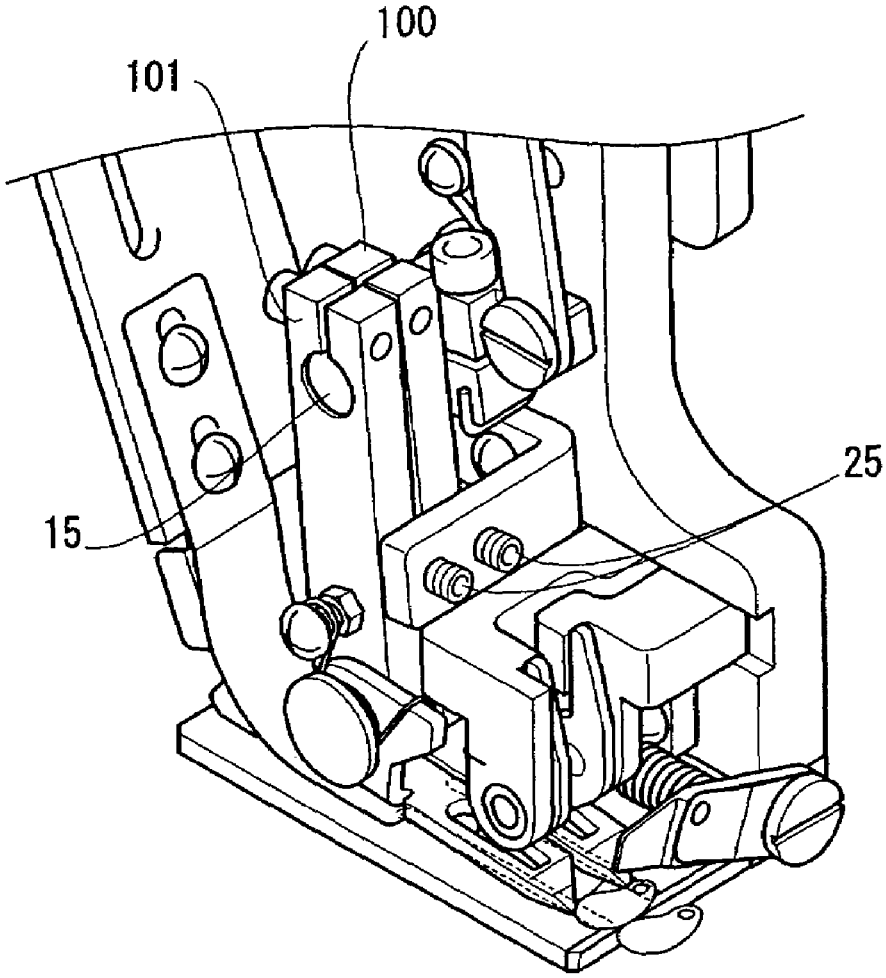
FIG. 13 is a perspective view showing still another modification of the sequin feeder apparatus shown in FIGS. 11 and 12.

In the illustrated example of FIGS. 11 and 12, the second pivot arm 101 is connected to the first pivot arm 100 in such a manner that the relative positions of the two pivot arms 100 and 101 are adjustable, as noted above. As a modification, the first pivot arm 100 and second pivot arm 101 may be mounted on the pivot shaft 15, as shown in FIG. 13. In this case, it is desirable that stoppers 25 be provided in corresponding relation to the two pivot arms 100 and 101 to allow the pivotal positions of the first pivot arm 100 and second pivot arm 101 to be regulated independently of each other.

According to the above-described present invention, which is arranged to feed out a sequin by causing the two engaging portions to engage a peripheral region of the sequin, it is possible to accurately feed out the sequin without any unnecessary force acting on the sequin to rotate the sequin generally about the connecting portion, even in the case where the sequin is of the type where the sewing hole is offset from the center of the sequin in the direction perpendicular to the sequin feeding direction. Thus, the present invention can prevent the sequin from producing an unwanted inclination due to deformation of the connecting portion, as a result of which the present invention accomplishes the superior advantageous benefit that sequins can be fed out reliably at a predetermined pitch irrespective of the position of their sewing holes.

The invention claimed is:

1. A sequin feeder apparatus for a sequin sewing machine, for feeding a continuous sequin strip having a multiplicity of continuously-connected sequins at a predetermined pitch corresponding to a size of a sequin of the continuous sequin strip in interlocked relation to sewing operation of the sewing machine the sequin feeder apparatus comprising:

a feed lever having at least two engaging portions engageable with a predetermined sequin of the continuous sequin strip to feed the continuous sequin strip, wherein the engaging portions of the feed lever engage at least two points of the continuous sequin strip in feeding the continuous sequin strip.

2. The sequin feeder apparatus as claimed in claim 1, wherein at least one of the engaging portions of the feed lever is adjustable in position relative to other of the engaging portions.

3. The sequin feeder apparatus as claimed in claim 1, further including a lock lever for immovably locking the continuous sequin strip during retracting movement of the feed lever, said lock lever having at least two engaging claws engageable with a predetermined sequin of the continuous sequin strip to immovably lock the continuous sequin strip.

4. The sequin feeder apparatus as claimed in claim 3, wherein at least one of the engaging claws of the lock lever is adjustable in position relative to other of the engaging claws.

5. The sequin feeder apparatus as claimed in claim 1, further including:

a supporting plate that supports sequins of the continuous sequin strip on an upper surface thereof;

a holding member that resiliently abuts against the upper surface of the supporting plate;

a severing mechanism that severs a sequin from the continuous sequin strip so that the sequin severed from the continuous sequin strip is sewable onto a sewing work piece.

6. A sequin feeder apparatus for a sequin sewing machine, for feeding a continuous sequin strip having a multiplicity of continuously-connected sequins at a predetermined pitch corresponding to a size of a sequin of the continuous sequin strip in interlocked relation to sewing operation of the sewing machine, the sequin feeder apparatus comprising:

a feed lever engageable with a predetermined sequin of the continuous sequin strip to feed the continuous sequin strip; and a lock lever for immovably locking the continuous sequin strip during retracting movement of the feed lever, wherein the lock lever has at least two engaging claws engageable with a predetermined sequin of the continuous sequin strip to immovably lock the continuous sequin strip.

7. The sequin feeder apparatus as claimed in claim 6, further including:

a supporting plate that supports sequins of the continuous sequin strip on an upper surface thereof;

a holding member that resiliently abuts against the upper surface of the supporting plate; and a severing mechanism that severs a sequin from the continuous sequin strip so that the sequin severed from the continuous sequin strip is sewable onto a sewing work piece.

* * * * *